US006238059B1

(12) United States Patent
Chen

(10) Patent No.: US 6,238,059 B1
(45) Date of Patent: May 29, 2001

(54) VARIOUS COLOR LIGHT REFRACTION BULB

(76) Inventor: Jsiang-Fu Chen, P.O. Box 7-820, Taipei (TW)

( * ) Notice: Subject to any disclaimer, the term of this patent is extended or adjusted under 35 U.S.C. 154(b) by 0 days.

(21) Appl. No.: 09/477,632

(22) Filed: Jan. 5, 2000

(51) Int. Cl.[7] ..... F21K 2/00

(52) U.S. Cl. ..... 362/211; 362/255; 362/213; 362/215; 362/231; 362/806; 362/232; 313/634; 313/272; 313/273

(58) Field of Search ..... 362/231, 806, 362/810, 232, 211, 213, 255, 215; 313/634, 272, 273

(56) References Cited

U.S. PATENT DOCUMENTS

D. 430,319 * 8/2000 Harris ..... D26/26

* cited by examiner

*Primary Examiner*—Sandra O'Shea
*Assistant Examiner*—Ali Alavi

(57) ABSTRACT

A various color light refraction bulb is disclosed. The bulb includes a lamp tube, tungsten silks and a core pillar. A concave ring is formed at a middle section of the lamp tube, so as to divide the core tube into an upper tube and a lower tube. The concave ring serves to refract light from the upper and lower tubes so as to present various colors. A cone shape surface is used to seal the lower side of the lower tube and is used as a reflecting region so as to project light toward the lamp tube; and therefore, a various light refraction bulb is formed.

1 Claim, 4 Drawing Sheets

PRIOR ART

VARIOUS COLOR LIGHT REFRACTION BULB

BACKGROUND OF THE INVENTION

Glass quality thorough radiant, occupy at present very important universal unilization ratio of generation however receive the population to concern, have been a people's livelihood physical life top necessary it a big assets. Per at present down bulb hull corpus construction all is tradition diameter corpus, past the glow-in-the-dark's source mild, compliant deficiency variance, dull. Again is decorate however talk as well none pleasant impression capability, economy exploitation it the practical use have lost value, thereupon current trend of events orientation is have again add reform necessity. Another at present a we subsistence space matter style tasty desire, pais decorate lamp except emphasizing the pleasant impression, as well supplicant new it extensive practical use value, then increase the novel breathing of space type cadence.

SUMMARY OF THE INVENTION

The main object of the present invention is to provide a kinds of many color and lusters polymerase light source bulb, especially in reference to lamp hull tube inside the segment establish possession cave face turn ring and tube to carry to seal to match ministry forming conic circle tube arc face. Consist in primarily said the ring by luck to lie in the core pillar ascend down two tungsten silks, then operation cave face to corner radian of turn ring coagulation lamp tube top down two different color and luster glow-in-the-darks, make refract out many color and lusters to come together the light source is its habit.

Another object of the present invention is to provide a kinds of many color and lusters polymerase light source bulb, is to use tube port conic circle tube ministry mount fall square present secondth reflection light source capability. Ad bulb acquisition top down dichromatic and different paragraph range project light upon diaphragm, coagulate the polymerase of many color light sources with inside segment to project the lamp is its habit.

DETAILED DESCRIPTION OF THE PREFERRED EMBODIMENT

Figure 1:
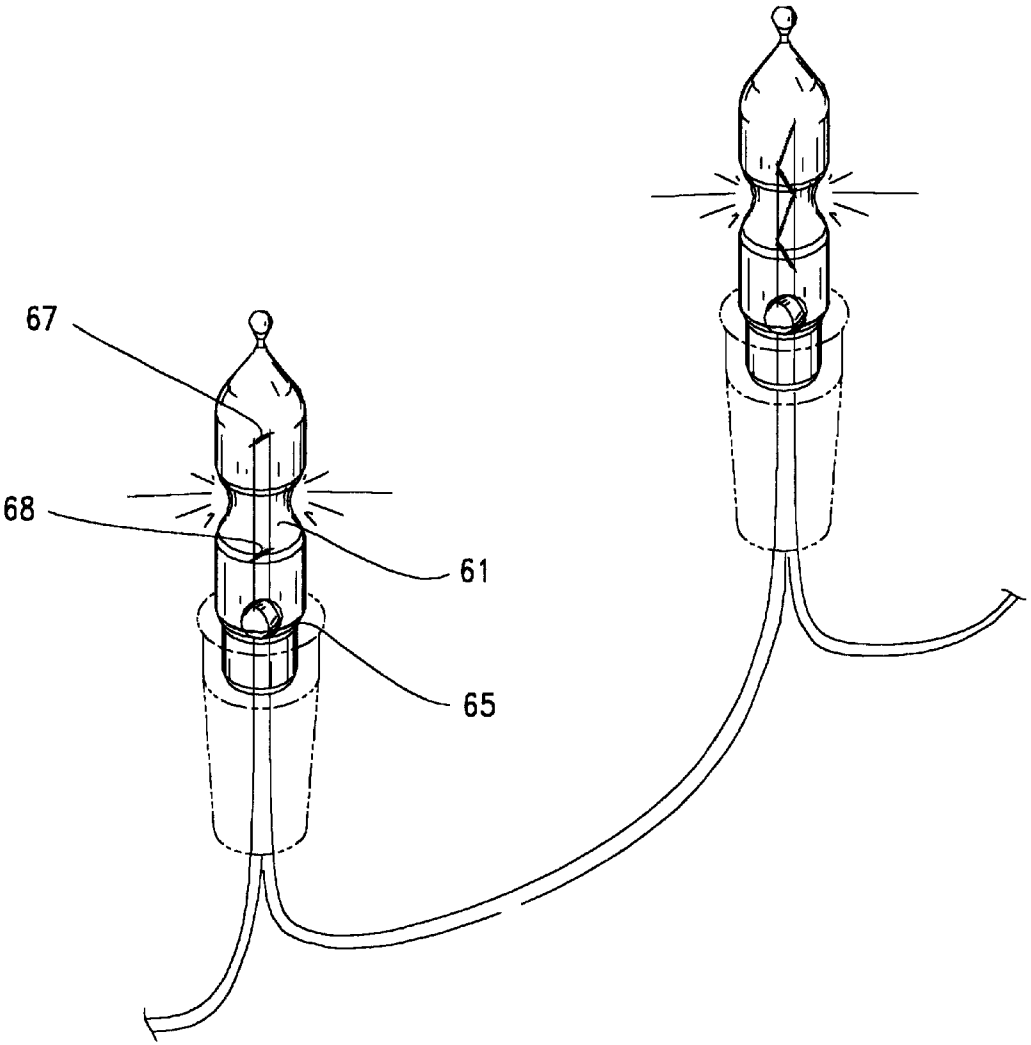
FIG. 1 is a perspective view of the present invention.
Figure 2:
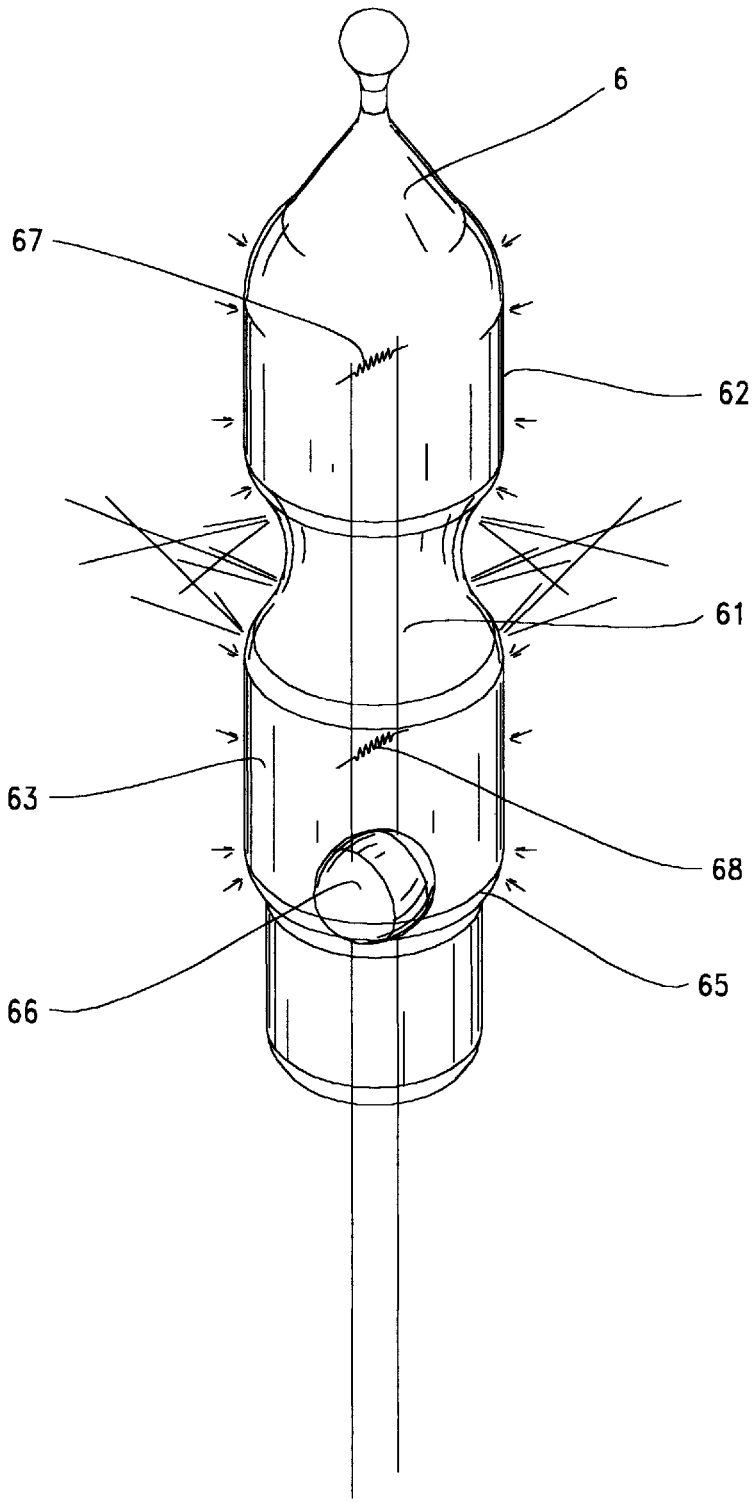
FIG. 2 is a perspective detail view of many color and lusters of this artistic polymerase light source bulb of the present invention.
Figure 3:
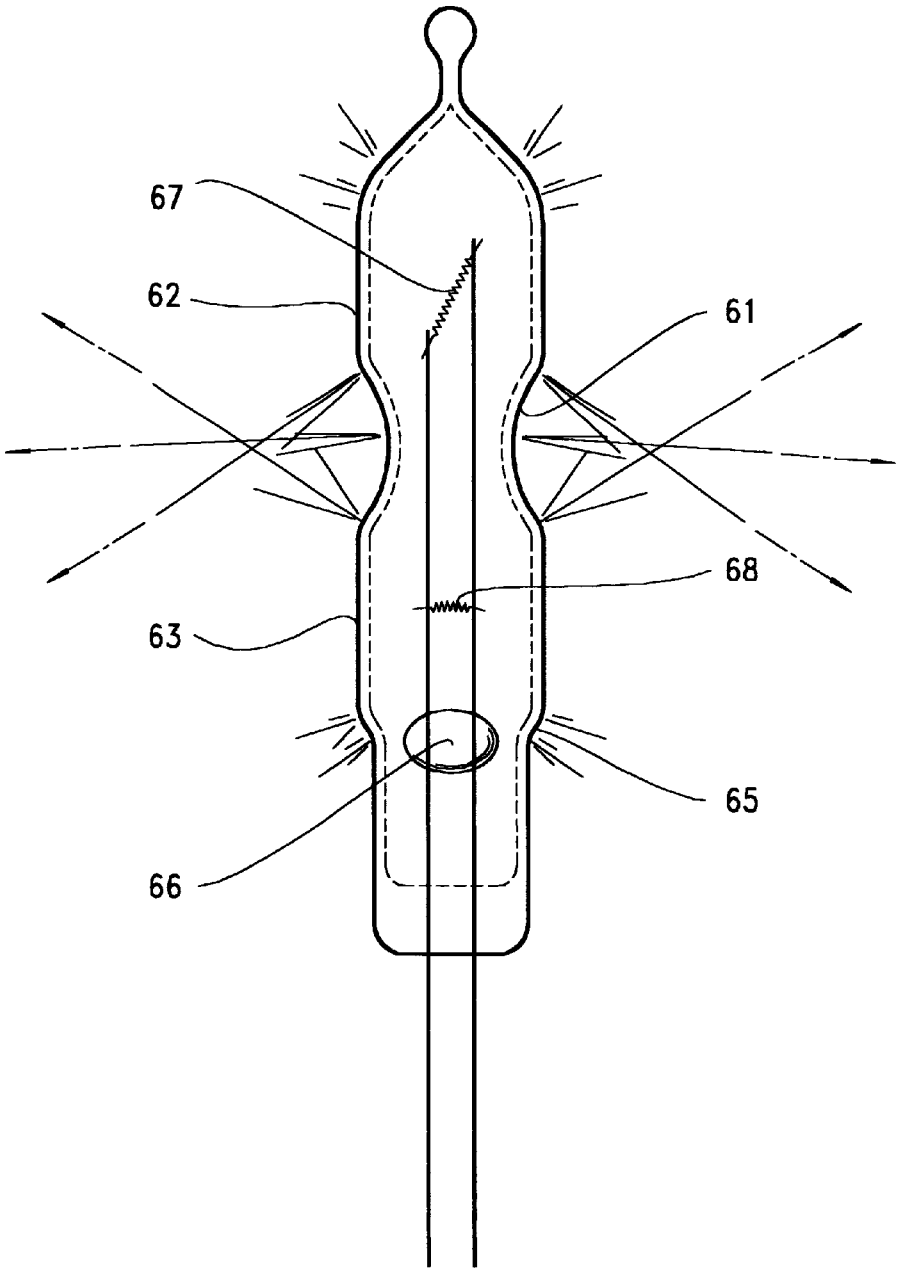
FIG. 3 is a perspective a view of a cave face turn ring lamp tube and conic circle tube of this artistic bulb top down two different refraction light source cross section of ranges.
Figure 4:
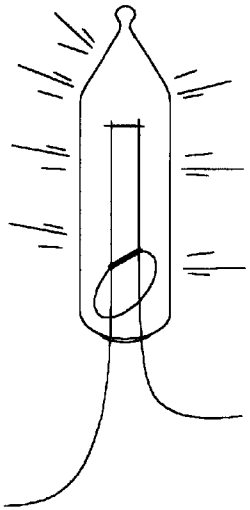
FIG. 4 is a view of this artistic lamp tube to construct to compare the diagram with tradition bulb tube.
Figure 4:
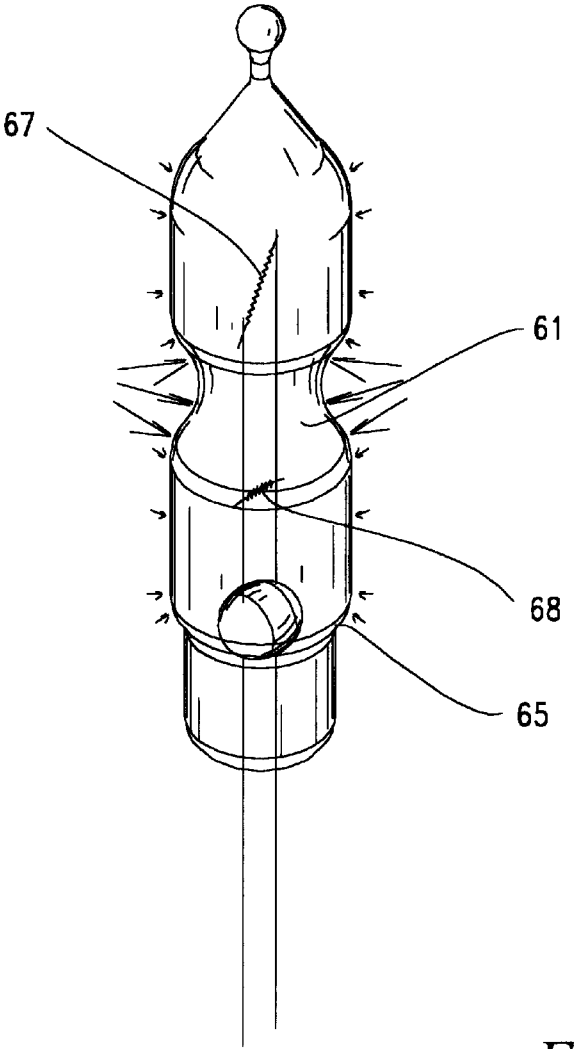

With reference to the drawings and in particular to FIG. 1 through 4, many color and lusters of this artistic polymerase light source bulb, its consist in the lamp tube of the bulb 6 primarily its inside segment design reach a cave underneath turn ring 61, make the bulb tube distinguish is top tube ministry 62 and down tube corpus 63. And said down the tube's creation match the ministry tube face is to forming conic circle tube arc face 65, in order to make inside segment design cave face turn ring, by luck locate its internal core pillar of bulb 66 develop the glow-in-the-dark ascend and down tungsten silk 67,68 positions in. However get make use of the cave face of this one turn of ring to establish bottom opposite angles radian to coagulate top tube ministry 62 and down tube corpus 63 tube circle on the faces two the glow-in-the-dark of the different color and lusters. Feed at mutually refraction however out the bunching light source of many color and lusters. At the same time use bottom tube to forming cone circle tube arc face mount fall square present secondth reflection zone light source, its entirety ad lamp tube acquisition top down dichromatic and different paragraph range project light upon diaphragm, coagulate the polymerase of many color light sources with inside segment to project the lamp is its habit.

What is claimed is:

1. A various color light refraction bulb comprising a lamp tube, tungsten silks and a core pillar, characterized in that a concave ring is formed at a middle section of the lamp tube, and thus the lamp tube being divided into an upper tube and a lower tube;

a cone shape surface being used to seal the lower side of the lower tube;

wherein the tungsten silks include an upper tungsten silk and a lower tungsten silk, and the concave ring is located therebetween so as to refract the light from the upper tube and lower tube to present various colors; the cone shape surface is used as a reflecting region so as to project light toward the lamp tube; therefore, a various light refraction bulb is formed.

* * * * *